US008707610B2

(12) United States Patent
Troy et al.

(10) Patent No.: US 8,707,610 B2
(45) Date of Patent: Apr. 29, 2014

(54) SCOPE MOUNTING APPARATUS FOR FIREARM

(75) Inventors: Stephen P. Troy, Lee, MA (US); David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 26 days.

(21) Appl. No.: 13/469,330

(22) Filed: May 11, 2012

(65) Prior Publication Data

US 2012/0291331 A1 Nov. 22, 2012

Related U.S. Application Data

(60) Provisional application No. 61/484,706, filed on May 11, 2011.

(51) Int. Cl.
*F41G 1/387* (2006.01)

(52) U.S. Cl.
USPC ..... 42/124

(58) Field of Classification Search
USPC ..... 42/124, 125, 127, 128; 89/41.17, 41.19
See application file for complete search history.

(56) References Cited

U.S. PATENT DOCUMENTS

| | | | | | |
|---|---|---|---|---|---|
| 960,813 | A * | 6/1910 | Burton | 42/124 |
| 3,276,127 | A * | 10/1966 | Abrahamson | 42/125 |
| 3,463,430 | A * | 8/1969 | Jimenez et al. | 42/124 |
| 4,216,600 | A * | 8/1980 | Brueckner et al. | 42/127 |
| 4,574,508 | A * | 3/1986 | Ross | 42/124 |
| 5,533,267 | A * | 7/1996 | Haight, Jr. | 42/124 |
| 5,694,712 | A * | 12/1997 | Plonka | 42/124 |
| 5,956,190 | A * | 9/1999 | Sieg | 359/827 |
| 2006/0123686 | A1* | 6/2006 | Larue | 42/127 |
| 2010/0175299 | A1* | 7/2010 | Lippard | 42/124 |
| 2011/0061286 | A1* | 3/2011 | Wang | 42/125 |
| 2012/0168589 | A1* | 7/2012 | Riley | 248/315 |

* cited by examiner

*Primary Examiner* — Bret Hayes
(74) *Attorney, Agent, or Firm* — Parsons & Goltry; Robert A. Parsons; Michael W. Goltry

(57) ABSTRACT

Scope mounting apparatus including a base designed to mate with a dovetail mounting rail on a firearm, and a mounting ring including arcuate elements pivotally joined together and movable between an open and a closed orientation. The ring is designed to receive a scope body in the open orientation and to enclose the scope body in the closed orientation. Mounting elements are fixed to the ring and positioned together in the closed orientation. A mounting block receives mounting elements therein. A mounting screw extends upwardly through the mounting block and into threaded engagement with a nut carried by the mounting elements. In the threadedly engaged orientation, the mounting screw and nut firmly hold the ring in the closed orientation.

16 Claims, 8 Drawing Sheets

SCOPE MOUNTING APPARATUS FOR FIREARM

CROSS-REFERENCE TO RELATED APPLICATION

This application claims the benefit of U.S. Provisional Patent Application No. 61/484,706, filed 11 May 2011.

FIELD OF THE INVENTION

This invention relates to scope mounting apparatus including rings for mounting scopes on firearms.

BACKGROUND OF THE INVENTION

Firearms of the type discussed herein generally include an upper receiver with a dove tail mounting rail positioned to receive scopes and other auxiliary equipment mounted thereon. In the prior art scopes have been mounted with from one to six screws that are visible and bulky. Further, because of the number of mounting screws and ancillary mounting apparatus, the prior art scopes are difficult to mount, bulky and very inconvenient.

It would be highly advantageous, therefore, to remedy the foregoing and other deficiencies inherent in the prior art.

Accordingly, it is an object of the present invention to provide new and improved scope rings and mounting apparatus for mounting scopes on firearms.

It is another object of the present invention to provide new and improved scope rings and mounting apparatus that can conveniently mount scopes on a firearm with a single screw and with a minimum of effort.

SUMMARY OF THE INVENTION

Briefly, to achieve the desired objects of the instant invention in accordance with a preferred embodiment thereof, scope mounting apparatus is provided for a firearm including an elongated base with a longitudinally extending dovetail slot designed to mate with a dovetail mounting rail on a firearm. An upper surface of the base forms an elongated channel with transversely extending grooves. At least one mounting ring includes a plurality of arcuate elements pivotally joined together and movable between an open and a closed orientation. The at least one mounting ring is designed to receive a scope body in the open orientation and to enclose the scope body in a coaxial relationship in the closed orientation. Mounting elements are fixed to the at least one mounting ring so as to be positioned together in the closed orientation and to define an enclosure therebetween designed to receive and hold a nut in a firmly non-rotating orientation. A mounting block defines a slot in the upper end designed to receive the positioned together mounting elements therein. The mounting block includes a lower surface designed to be engaged in the elongated channel in the upper surface of the base and to be engaged in at least one transverse groove of the elongated channel and an upper surface designed to receive a portion of the outer circular surface of the at least one mounting ring with the mounting elements received in the slot in the upper end. A mounting screw is designed to extend upwardly through the elongated base from a lower surface, through the mounting block and into threaded engagement with the nut held between the mounting elements. In the threadedly engaged orientation the mounting screw and nut firmly hold the at least one mounting ring in the closed orientation enclosing the scope body, the mounting elements fixedly engaged in the mounting block and the mounting block fixedly engaged in at least one groove in the upper surface of the base.

The desired objects of the instant invention are further achieved in accordance with an embodiment of scope mounting apparatus including a firearm having a dovetail mounting rail, a scope having an elongated cylindrical body, an eye piece at one end of the body, and a light gathering end at an opposite end of the body, and mounting apparatus. The mounting apparatus including an elongated base with a longitudinally extending dovetail slot defined in a lower surface of the base and designed to mate with the dovetail mounting rail on the firearm, an upper surface of the base forming an elongated channel with transversely extending grooves. At least one mounting ring including a pair of semi-circular arcuate elements pivotally joined together adjacent one end and having mating mounting elements attached to the opposed ends of the pair of elements. The at least one mounting ring is movable between an open and a closed orientation and is designed to receive the scope body in the open orientation and to enclose the scope body in a coaxial relationship in the closed orientation. The mating mounting elements are fixed to the pair of semi-circular arcuate elements so as to be positioned together in the closed orientation and to define an enclosure therebetween designed to receive and hold a nut in a firmly non-rotating orientation. A mounting block defines a rectangularly shaped slot in the upper end designed to receive the positioned together mounting elements therein. The mounting block includes a lower surface designed to be engaged in the elongated channel in the upper surface of the base and to be engaged in at least one transverse groove of the elongated channel and an upper surface designed to receive a portion of the outer circular surface of the at least one mounting ring therein with the mounting elements received in the slot in the upper end. A mounting screw designed to extend upwardly through the elongated base from a lower surface, through the mounting block and into threaded engagement with the nut held between the mounting elements. In the threadedly engaged orientation the mounting screw and nut firmly hold the at least one mounting ring in the closed orientation enclosing the scope body, the mounting elements fixedly engaged in the mounting block and the mounting block fixedly engaged in at least one groove in the upper surface of the elongated base.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
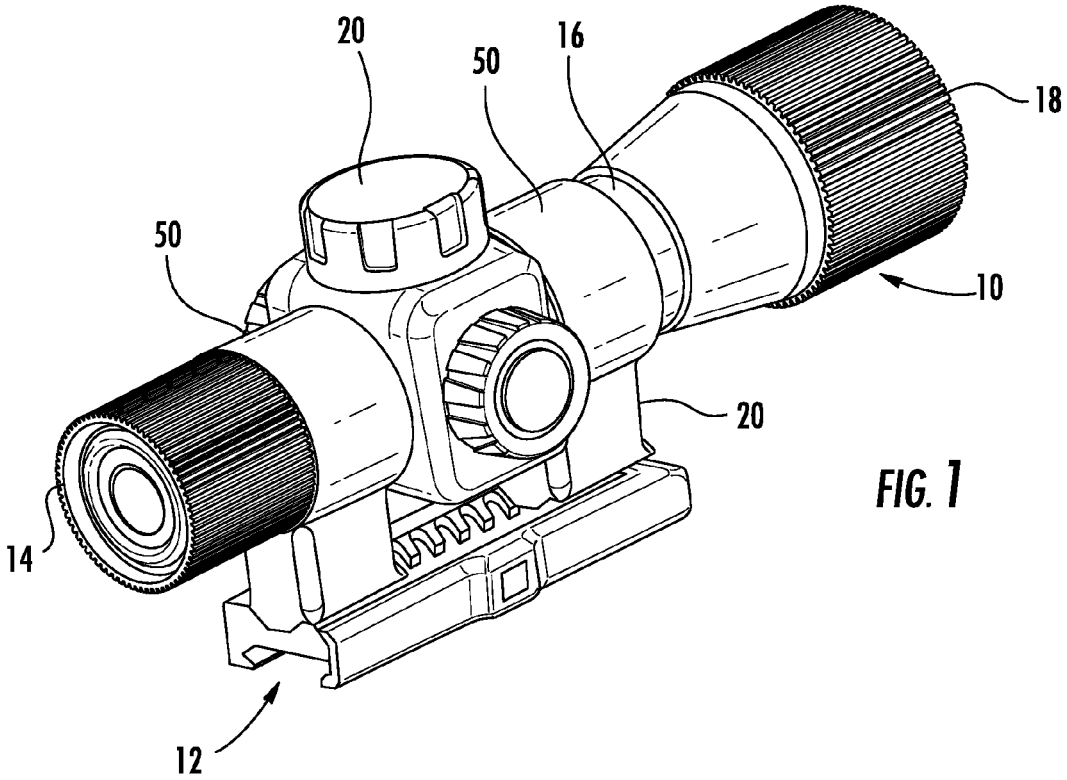
FIG. 1 is a perspective view of a typical firearm scope with attached dual scope rings and mounting apparatus in accordance with the present invention.

Turning to FIG. 1 a typical firearm scope 10 with attached dual scope rings and mounting apparatus 12 in accordance with the present invention are illustrated. It will be understood that scope 10 is illustrated herein only as an example of a typical firearm scope well known in the art and that other scopes may be used in place thereof. Scope 10 includes an eye piece 14, an elongated cylindrical body 16, and a light gathering end 18. Scope 10 also includes well known adjustments 20 for distance, and other shooting associated functions.

Figure 2:
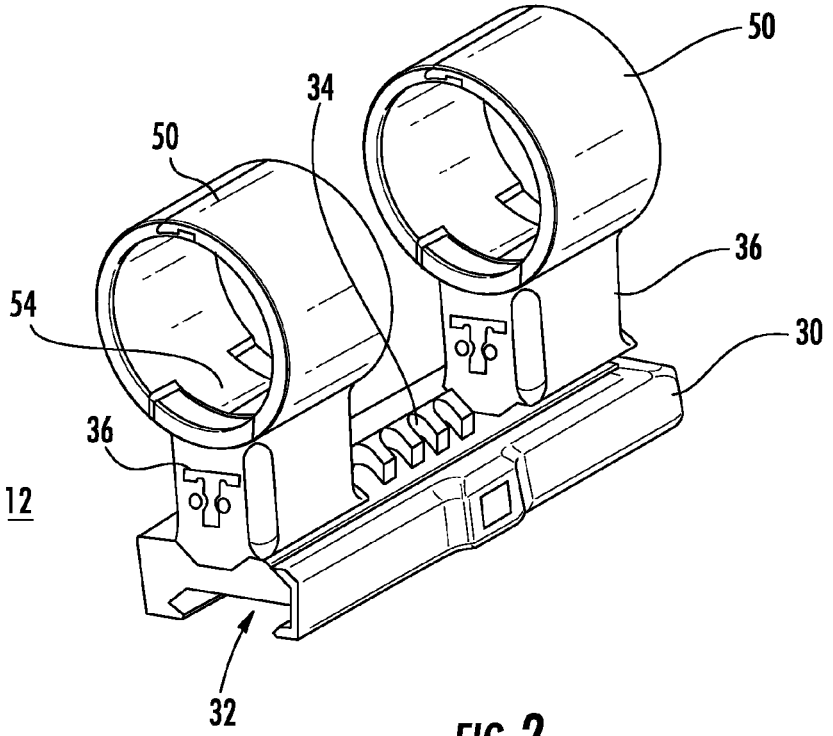
FIG. 2 is a perspective view of the scope rings and mounting apparatus of FIG. 1 with the scope removed.

Dual scope rings and mounting apparatus 12 are illustrated in FIG. 2 with scope 10 removed to better illustrate the various components. It should be understood that the entire structure, including the scope rings, are considered herein to be "mounting apparatus" 12 even though the scope rings may, in some instances be referred to as separate components. Referring more specifically to FIG. 2, mounting apparatus 12 includes an elongated base 30 with a downwardly opening, longitudinally extending dovetail slot 32 designed to mate with well known dovetail mounting rails on both military and personal firearms. The upper surface of base 30 slopes generally arcuately downward to form an elongated channel 34 with transversely extending grooves designed to receive the lower ends of a pair of mounting blocks 36. Channel 34 and the transverse grooves cooperate to receive and firmly hold the lower ends of mounting blocks 36 in a fixed non-moving relationship as will be better understood from the description below.

Figure 3:
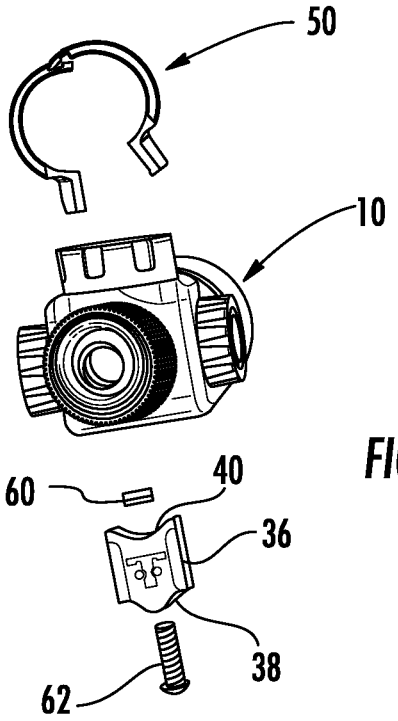
FIG. 3 is a perspective view of portions of an exploded scope ring and mounting apparatus.

Referring additionally to FIG. 3, a mounting block 36 is illustrated in a view of portions of an exploded scope ring and mounting apparatus. Mounting block 36 is formed with a generally arcuately shaped lower surface 38 designed to be received in channel 34 and the included transverse grooves of base 30. Further, mounting block 36 is formed with a generally arcuately shaped upper surface 40 designed to receive a portion of the outer circular surface of a mounting ring 50 coaxially engaged therein.

Figure 4:
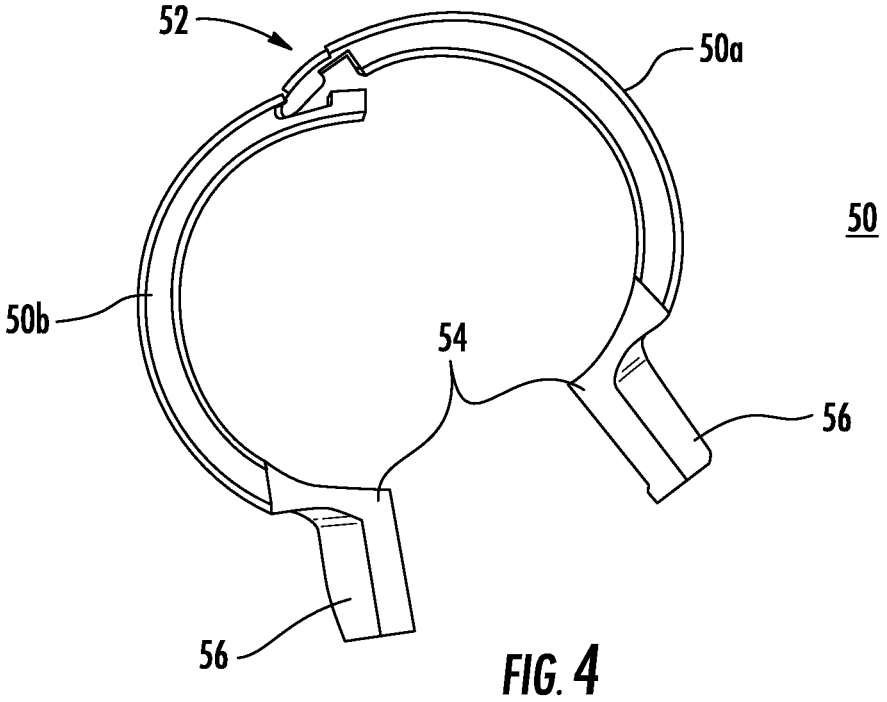
FIG. 4 is an enlarged perspective view of a scope ring in a scope accepting orientation.
Figure 7:
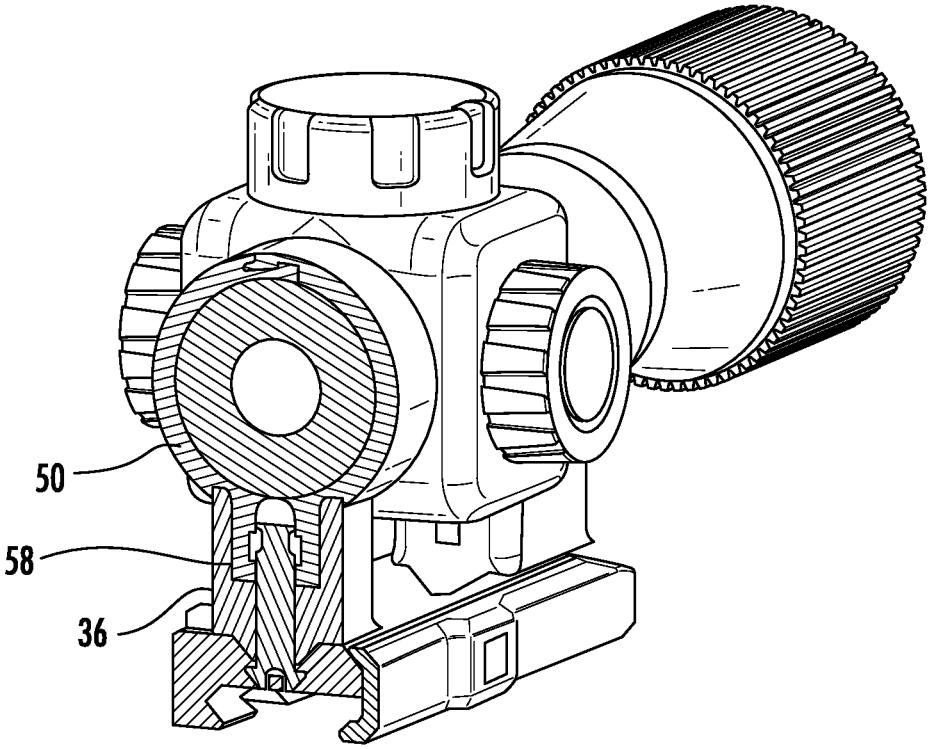
FIG. 7 is a sectional perspective view of the firearm scope of FIG. 1, illustrating the scope rings and mounting apparatus in more detail.
Figure 8:
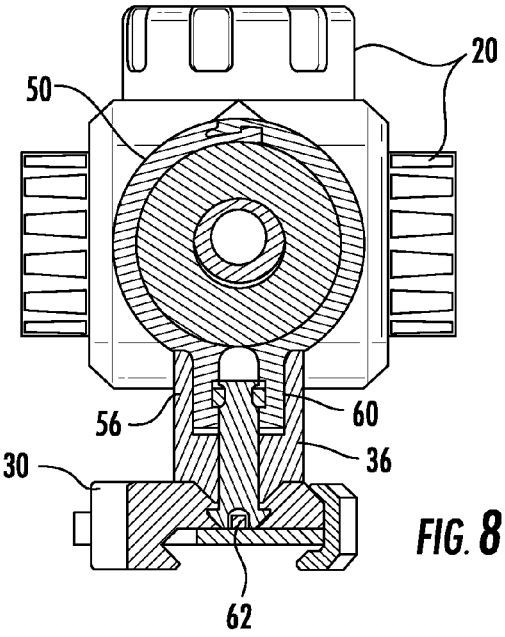
FIG. 8 is a rear sectional view illustrating the scope rings and mounting apparatus in more detail.
Figure 9:
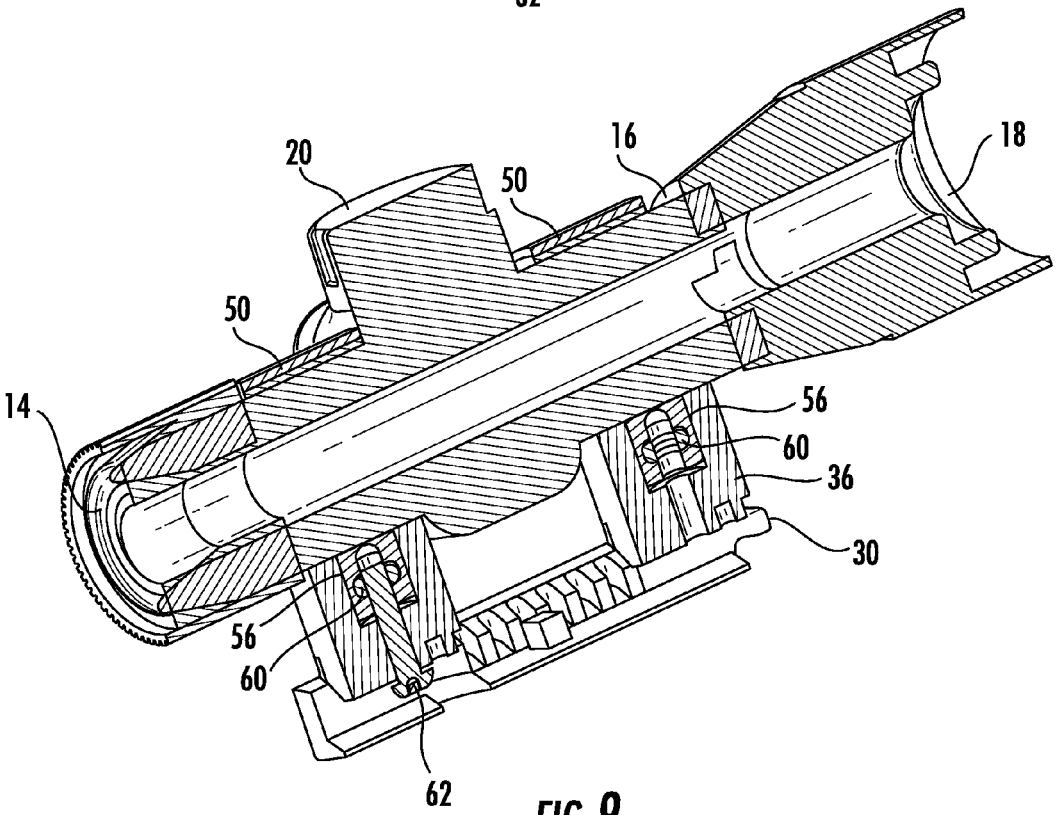
FIG. 9 is a sectional view of the firearm scope with the attached scope rings and mounting apparatus of FIG. 1.
Figure 10:
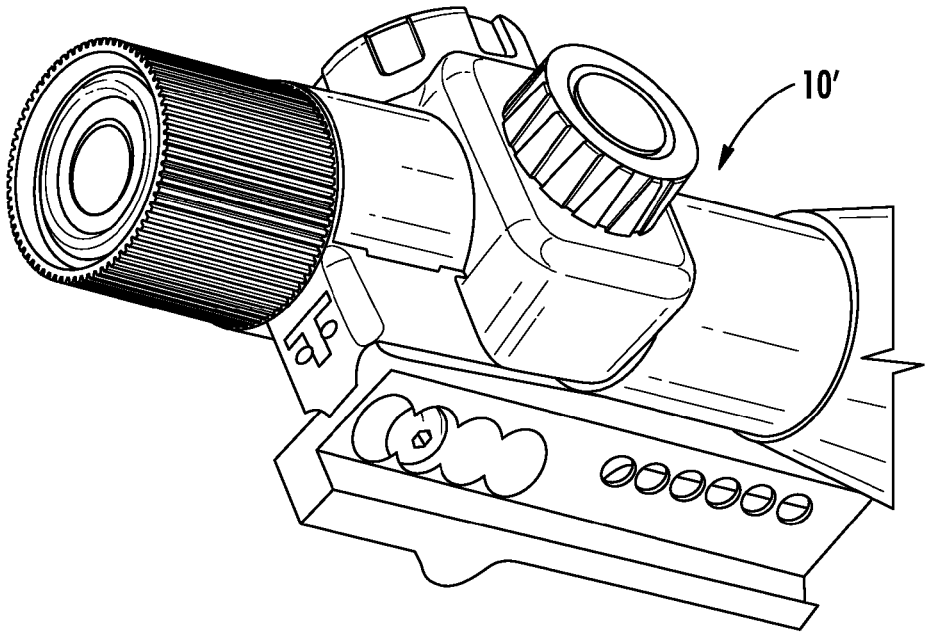
FIG. 10 is a perspective view of a typical firearm scope with a single attached scope ring and mounting apparatus in accordance with the present invention.
Figure 11:
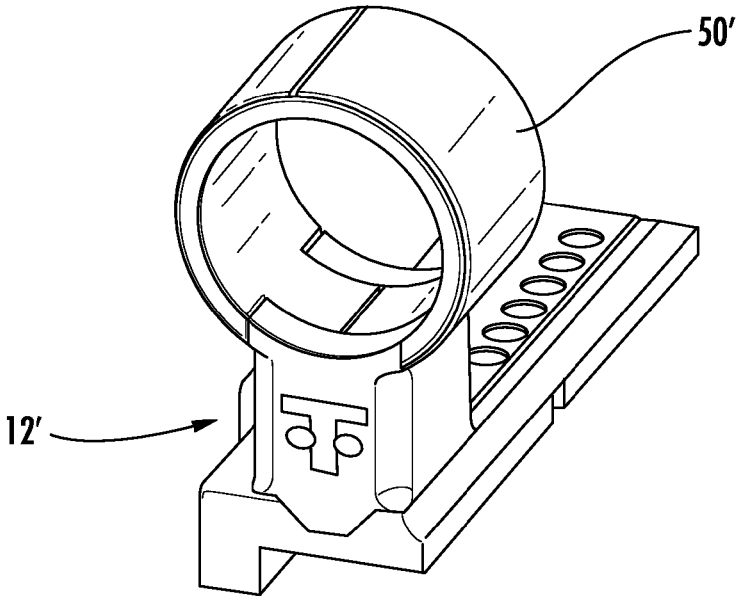
FIG. 11 is a perspective view of the single scope ring and mounting apparatus of FIG. 10 with the scope removed.
Figure 12:
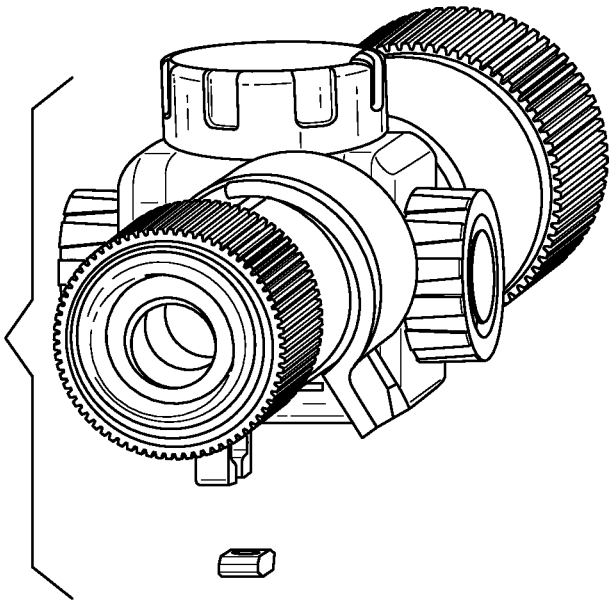
FIGS. 12, 13, 14, and 15 are perspective views of the single scope ring and mounting apparatus assembled to mount a scope in accordance with the present invention.
Figure 13:
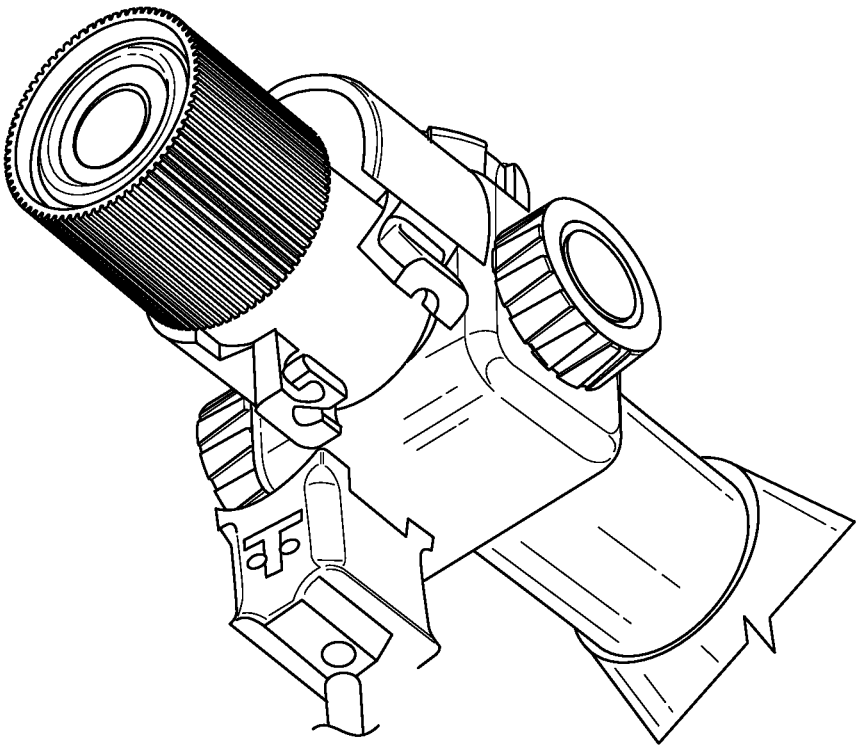
Figure 14:
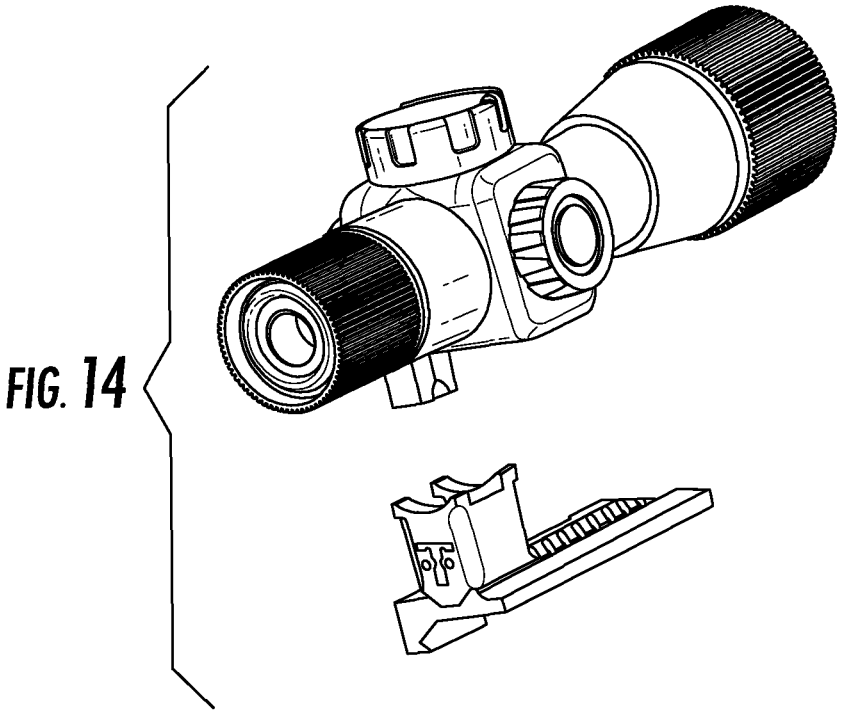
Figure 15:
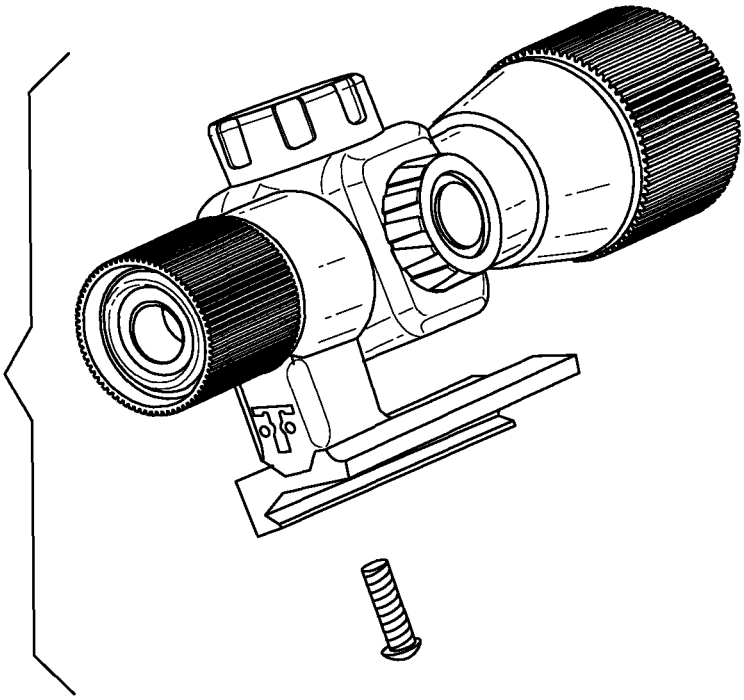

Referring additionally to FIG. 4, a mounting ring 50 is illustrated in detail. As can be seen, mounting ring 50 includes two substantially semi-circular elements 50*a* and 50*b* which are joined or hinged at an upper end, designated 52. The joint or hinge 52 allows semi-circular elements 50*a* and 50*b* to be pivoted apart, as illustrated in FIG. 4, so as to receive a scope body (e.g. cylindrical body 16 of scope 10) in a coaxial relationship therebetween. A lower end 54 of each semi-circular element 50*a* and 50*b* includes a radially downwardly extending, generally rectangularly shaped mounting element 56 integrally formed thereon. Lower ends 54 are designed to matingly engage (best seen in FIG. 2) to form a complete circle with mounting elements 56 positioned together so as to be receivable in a slot or groove 58 in the upper end of mounting block 36 (best seen in FIGS. 7, 8, and 9). Also, when positioned together, mounting elements 56 define an enclosure therebetween designed to receive and hold a nut 60 in a firmly non-rotating orientation.

Figure 6:
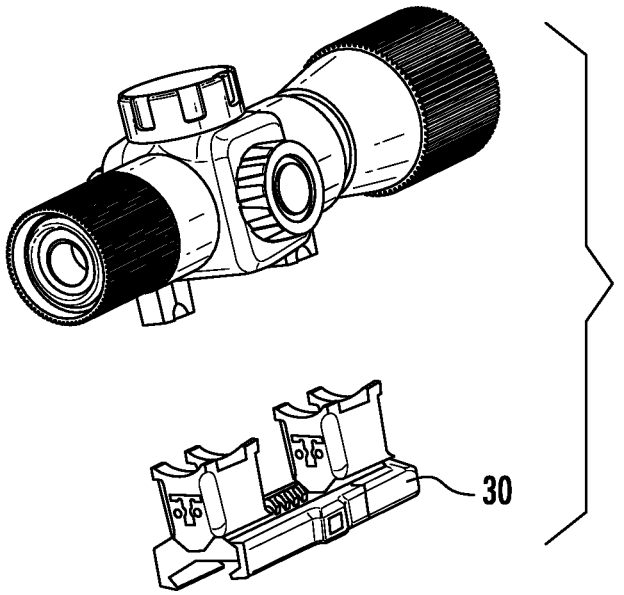
FIG. 6 is a perspective view, similar to FIG. 5, illustrating the scope ring ready to be installed on the mounting apparatus.
Figure 5:
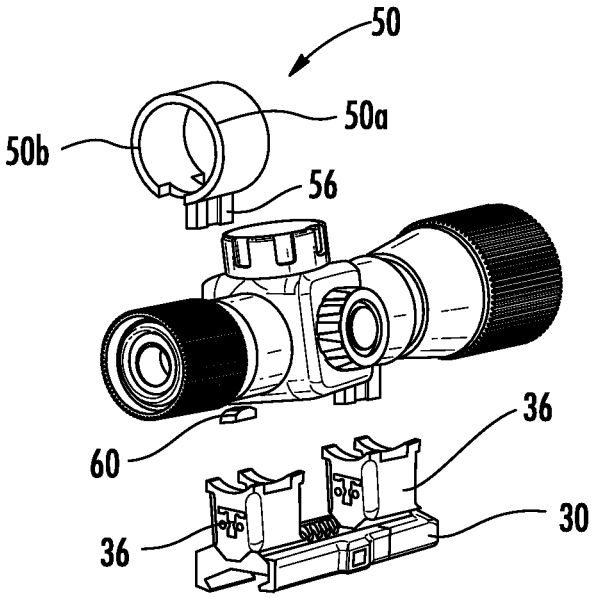
FIG. 5 is a perspective view illustrating the scope ring ready to be installed on the mounting apparatus.

In the scope mounting operation and referring additionally to FIG. 5, semi-circular elements 50*a* and 50*b* of ring 50 are pivoted into the scope receiving orientation illustrated in FIG. 4. Semi-circular elements 50*a* and 50*b* are then rotated around body 16 of scope 10 into a scope locking or engaging orientation, as illustrated in FIG. 6, while enclosing nut 60 between mounting elements 56. Mounting elements 56, with nut 60 firmly engaged therebetween, are then inserted into slot or groove 58 in the upper end of mounting block 36. Lower end 38 of mounting block 36 is positioned in channel 34 of base 30 and a mounting screw 62 is inserted from the bottom of base 30, through a centrally located, longitudinally extending slot or spaced apart openings upwardly into an opening defined in cooperation by mounting elements 56 and into threaded engagement with nut 60. Here it will be understood that the terms "screw" and "nut" are defined as any combination of elements designed to extend through the base 30 and adjustable to tighten mounting elements 56 in mounting block 36 and hold ring 50 tightly engaged around the scope body. Tightening screw 62 pulls mounting elements 56 tightly into engagement with mounting block 36, thus snuggly engaging body 16 of scope 10 coaxially within ring 50 and, simultaneously, tightly locking mounting block 36 into a selected longitudinal position in channel 34 of base 30 (see FIGS. 8 and 9). A second ring, mounting block, nut, and screw are then engaged in a similar fashion to mount scope 10 with dual mounting rings. Base 30 can then be mated with a well known dovetail mounting rail (not shown) to fixedly position scope 10 on a firearm. A catch 31 positioned on the side of base 30 is movable between a locked and an unlocked orientation and in the locked orientation locks base 30 in any selected longitudinal position along the dovetail mounting rail of the firearm.

Turning to FIGS. 10-15, an embodiment is illustrated in which a single mounting ring 50' and associated mounting apparatus 12' are used to mount a scope 10'. In this embodiment all of the components described above in conjunction with the dual mounting ring arrangement are incorporated except that a single mounting ring is used. It will be clear that any number (e.g. one or more) of mounting rings could be used depending upon the specific scope being mounted and the application to which the scope is being applied.

Thus, new and improved scope mounting apparatus is illustrated and described. The new and improved scope mounting apparatus uses a single screw to hold the entire ring and mounting assembly fixedly together and in a selected orientation. Also, the new and improved scope mounting apparatus is designed to provide a user with a more stable mount and is specifically designed to be easily and conveniently installed on any firearm. Also, the improved scope mounting apparatus is relatively inexpensive and can be quickly and easily changed as needed.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

Having fully described the invention in such clear and concise terms as to enable those skilled in the art to understand and practice the same, the invention claimed is:

1. Scope mounting apparatus comprising:

an elongated base with a longitudinally extending dovetail slot designed to mate with a dovetail mounting rail on a firearm, an upper surface of the base forming an elongated channel with transversely extending grooves;

at least one mounting ring including a plurality of arcuate elements pivotally joined together and movable between an open and a closed orientation, the at least one mounting ring designed to receive a scope body in the open orientation and to enclose the scope body in a coaxial relationship in the closed orientation, mounting elements fixed to the at least one mounting ring so as to be positioned together in the closed orientation and to define an enclosure therebetween designed to receive and hold a nut in a firmly non-rotating orientation;

a mounting block with a slot in an upper end thereof, the slot designed to receive the positioned together mounting elements therein, the mounting block includes a lower surface designed to be engaged in the elongated channel in the upper surface of the base and to be engaged in at least one transverse groove of the elongated channel and an upper surface designed to receive in abutting engagement a portion of the outer circular surface of the at least one mounting ring with the mounting elements received in the slot in the upper end; and a mounting screw designed to extend upwardly through the elongated base from a lower surface, through the mounting block and into threaded engagement with the nut held between the mounting elements, in the threadedly engaged orientation the mounting screw and nut firmly holding the at least one mounting ring in the closed orientation enclosing the scope body, the mounting elements fixedly engaged in the mounting block and the mounting block fixedly engaged in at least one groove in the upper surface of the base.

2. Scope mounting apparatus as claimed in claim 1 wherein the longitudinally extending dovetail slot is defined in a lower surface of the elongated base.

3. Scope mounting apparatus as claimed in claim 1 wherein the at least one mounting ring includes a pair of semi-circular elements pivotally attached together at one end and having mating mounting elements attached to opposed ends.

4. Scope mounting apparatus as claimed in claim 3 wherein the mating mounting elements include a generally rectangularly shaped mounting element attached to the opposed end of each semi-circular element of the pair of semi-circular elements.

5. Scope mounting apparatus as claimed in claim 4 wherein the mating generally rectangularly shaped mounting element cooperate to define an enclosure formed to hold a nut in the firmly non-rotating orientation and to receive the mounting screw through an opening in a lower end.

6. Scope mounting apparatus as claimed in claim 5 wherein the mating generally rectangularly shaped mounting elements are integrally formed, one each, with each semi-circular element.

7. Scope mounting apparatus as claimed in claim 5 wherein the slot in the upper end of the mounting block includes a generally rectangularly shaped depression formed to receive the generally rectangularly shaped mounting elements therein and further includes an opening in a lower surface designed to receive the mounting screw therethrough.

8. Scope mounting apparatus as claimed in claim 1 including two mounting rings each with attached mounting elements and two mounting blocks.

9. Scope mounting apparatus as claimed in claim 1 wherein the upper surface of the mounting block is designed to receive a portion of the outer circular surface of the at least one mounting ring coaxially engaged therewith.

10. Scope mounting apparatus comprising:

an elongated base with a longitudinally extending dovetail slot defined in a lower surface of the base and designed to mate with a dovetail mounting rail on a firearm, an upper surface of the base forming an elongated channel with transversely extending grooves;

at least one mounting ring including a pair of semi-circular arcuate elements pivotally joined together adjacent one end and having mating mounting elements attached to opposed ends, the at least one mounting ring being movable between an open and a closed orientation and designed to receive a scope body in the open orientation and to enclose the scope body in a coaxial relationship in the closed orientation, the mating mounting elements fixed to the pair of semi-circular arcuate elements so as to be positioned together in the closed orientation and to define an enclosure therebetween designed to receive and hold a nut in a firmly non-rotating orientation;

a mounting block with a rectangularly shaped slot in an upper end thereof, the rectangular slot designed to receive the positioned together mounting elements therein, the mounting block includes a lower surface designed to be engaged in the elongated channel in the upper surface of the base and to be engaged in at least one transverse groove of the elongated channel and an upper surface designed to receive in abutting engagement a portion of the outer circular surface of the at least one mounting ring coaxially engaged therein with the mounting elements received in the slot in the upper end; and a mounting screw designed to extend upwardly through the elongated base from a lower surface, through the mounting block and into threaded engagement with the nut held between the mounting elements, in the threadedly engaged orientation the mounting screw and nut firmly holding the at least one mounting ring in the closed orientation enclosing the scope body and the mounting elements fixedly engaged in the mounting block and the mounting block fixedly engaged in at least one groove in the upper surface of the elongated base.

11. Scope mounting apparatus as claimed in claim 10 wherein the mating generally rectangularly shaped mounting elements are integrally formed, one each, with each semi-circular element.

12. Scope mounting apparatus as claimed in claim 10 including two mounting rings each with attached mounting elements and two mounting blocks.

13. Scope mounting apparatus as claimed in claim 10 wherein the upper surface of the mounting block is designed to receive a portion of the outer circular surface of the at least one mounting ring coaxially engaged therewith.

14. Scope mounting apparatus comprising:

a firearm having a dovetail mounting rail;

a scope having an elongated cylindrical body, an eye piece at one end of the body, and a light gathering end at an opposite end of the body;

mounting apparatus including:

an elongated base with a longitudinally extending dovetail slot defined in a lower surface of the base and designed to mate with the dovetail mounting rail on the firearm, an upper surface of the base forming an elongated channel with transversely extending grooves;

at least one mounting ring including a pair of semi-circular arcuate elements pivotally joined together adjacent one end and having mating mounting elements attached to opposed ends, the at least one mounting ring being movable between an open and a closed orientation and designed to receive the scope body in the open orientation and to enclose the scope body in a coaxial relationship in the closed orientation, the mating mounting elements fixed to the pair of semi-circular arcuate elements so as to be positioned together in the closed orientation and to define an enclosure therebetween designed to receive and hold a nut in a firmly non-rotating orientation;

a mounting block with a rectangularly shaped slot in an upper end thereof, the rectangular slot designed to receive the positioned together mounting elements therein, the mounting block includes a lower surface designed to be engaged in the elongated channel in the upper surface of the base and to be engaged in at least one transverse groove of the elongated channel and an upper surface designed to receive a portion of the outer circular surface of the at least one mounting ring coaxially engaged therein with the mounting elements received in the slot in the upper end; and a mounting screw designed to extend upwardly through the elongated base from a lower surface, through the mounting block and into threaded engagement with the nut held between the mounting elements, in the threadedly engaged orientation the mounting screw and nut firmly holding the at least one mounting ring in the closed orientation enclosing the scope body and the mounting elements fixedly engaged in the mounting block and the mounting block fixedly engaged in at least one groove in the upper surface of the elongated base.

15. Scope mounting apparatus as claimed in claim 14 wherein the mating generally rectangularly shaped mounting elements are integrally formed, one each, with each semi-circular element.

16. Scope mounting apparatus as claimed in claim 14 wherein the mounting apparatus includes two mounting rings each with attached mounting elements and two mounting blocks.

* * * * *